US006153266A

United States Patent [19]

Yokogawa et al.

[11] Patent Number: 6,153,266

[45] Date of Patent: Nov. 28, 2000

[54] METHOD FOR PRODUCING CALCIUM PHOSPHATE COATING FILM

[75] Inventors: Yoshiyuki Yokogawa, Komaki; Tetsuya Kameyama, Nagoya; Yukari Kawamoto, Urawa; Kaori Nishizawa, Owariasahi; Fukue Nagata, Nagoya; Kohji Okada, Iwakura; Hiroshi Sumi, Ichinomiya, all of Japan

[73] Assignees: Japan as represented by Director General Agency of Industrial Science and Technology, Tokyo; NGK Spark Plug Co., Ltd., Nagoya, both of Japan

[21] Appl. No.: 09/206,265

[22] Filed: Dec. 7, 1998

[30] Foreign Application Priority Data

Dec. 8, 1997 [JP] Japan ..... 9-356208

[51] Int. Cl.[7] ..... B05D 1/38; B05D 3/02; B05D 1/18

[52] U.S. Cl. ..... 427/419.1; 427/2.27; 427/301; 427/372.2; 427/430.1

[58] Field of Search ..... 427/2.27, 307, 427/301, 372.2, 419.1, 430.1

[56] References Cited

U.S. PATENT DOCUMENTS

| | | | |
|---|---|---|---|
| 4,687,675 | 8/1987 | Nakano et al. | 427/2 |
| 4,794,023 | 12/1988 | Shimamune et al. | 427/350 |
| 4,818,559 | 4/1989 | Hama et al. | 427/2 |
| 4,911,953 | 3/1990 | Hosonuma et al. | 427/224 |
| 5,068,122 | 11/1991 | Kokubo et al. | 427/2 |
| 5,128,169 | 7/1992 | Saita et al. | 427/2 |
| 5,472,734 | 12/1995 | Perrotta et al. | 427/2 |
| 5,698,265 | 12/1997 | Mucalo et al. | 427/333 |
| 5,766,669 | 6/1998 | Pugh et al. | 427/2.27 |

FOREIGN PATENT DOCUMENTS

| | | |
|---|---|---|
| 58-109049 | 6/1983 | Japan . |
| 62-34559 | 2/1987 | Japan . |
| 62-57548 | 3/1987 | Japan . |
| 62-231669 | 10/1987 | Japan . |
| 63-24952 | 2/1988 | Japan . |
| 63-46165 | 2/1988 | Japan . |
| 63-160663 | 7/1988 | Japan . |
| 2-255515 | 10/1990 | Japan . |
| 4-141177 | 5/1992 | Japan . |
| 4-144566 | 5/1992 | Japan . |
| 6-293506 | 10/1994 | Japan . |
| 8-260348 | 10/1996 | Japan . |

*Primary Examiner*—Shrive Beck
*Assistant Examiner*—Michael Barr
*Attorney, Agent, or Firm*—Morgan, Lewis & Bockius LLP

[57] ABSTRACT

The present invention provides a method for producing a calcium phosphate coating film on the surface of a substrate, even a substrate which has poor heat resistance. The method comprises the steps of soaking a substrate in a first solution containing phosphate ions, inter alia, aqueous solutions of a basic phosphate salt such as $Na_3PO_4$ or $Na_2HPO_4$; removing the substrate and drying it; and soaking the substrate in a second solution (aqueous solution) containing calcium ions, to thereby obtain a coating film comprising hydroxyapatite or a mixture containing hydroxyapatite and a hydroxyapatite precursor. The substrate removed from the second solution may be soaked in a third solution (aqueous solution) containing an apatite component at a substantially saturated or supersaturated concentration, to thereby form a hydroxyapatite coating film. There may be used substrates formed of metals, ceramics, organic polymer materials, etc. The method is applicable to a substrate having poor heat resistance, such as synthetic resin fabric, due to omission of high-temperature treatment.

29 Claims, 2 Drawing Sheets

METHOD FOR PRODUCING CALCIUM PHOSPHATE COATING FILM

BACKGROUND OF THE INVENTION

1. Field of the Invention

The present invention relates to a method for producing a coating film comprising hydroxyapatite, or a mixture containing hydroxyapatite and a hydroxyapatite precursor, on the surface of a substrate by use of two or three specific kinds of solutions, under specific conditions in accordance with needs. In the present invention, a coating film of hydroxyapatite having excellent bioactivity is formed on the surface of any of a variety of substrates, and the coated objects are applied to a variety of medical equipment, medical materials, etc. Also, a hydroxyapatite coating film is formed on the surface of fiber constituting a substrate such as woven fabric or non-woven fabric, to thereby serve as a mask or any of a variety of filter materials.

2. Background Art

With regard to methods for forming a hydroxyapatite coating film, there are known a plasma spraying method described in Japanese Patent Application Laid-Open (kokai) Nos. 62-34559, 62-57548, and 63-160663; a method described in Japanese Patent Application Laid-Open (kokai) Nos. 62-231669, 63-24952, and 63-46165 in which a solution or a compound containing calcium and phosphorus is applied to the surface of a substrate and the coating is sintered; etc. There are also known a sputtering method described in Japanese Patent Application Laid-Open (kokai) No. 58-109049; a flame spraying method described in the Proceedings of the First Autumn Symposium 1988 of Japan Ceramic Association, p.p. 401–402; an electrophoresis method described in the Proceedings of the First Autumn Symposium 1988 of Japan Ceramic Association, p.p. 417–418; etc.

Furthermore, there is also proposed a method which mimics a mechanism of osteogenesis in organisms, which method comprises the steps of introducing on the surface of a substrate sites for inducing formation of hydroxyapatite nuclei and soaking the substrate in simulated body fluid to grow the nuclei. Examples of the method for introducing sites inducing formation of hydroxyapatite nuclei include methods employing bioactive glass described in Japanese Patent Application Laid-Open (kokai) Nos. 4-141177 and 6-293506 and Japanese Patent Publication (kokoku) Nos. 6-29126 and 7-24686 and a method in which a substrate is phosphorylated described in Japanese Patent Application Laid-Open (kokai) No. 8-260348.

However, a method requiring high-temperature treatment, such as a plasma spraying method, is difficult to apply to substrates having poor heat resistance that comprise, for example, an organic polymer material. There is also a problem that formed hydroxyapatite is not quite the same as the hydroxyapatite found in organisms. In contrast, a method which mimics a mechanism of osteogenesis in organisms enables formation of an apatite coating film approximately similar to that found in organisms, on a substrate comprising a material having poor heat resistance such as an organic polymer material as well as a material having high heat resistance such as ceramics. However, in a method in which bioactive glass is employed so as to introduce sites for inducing apatite nuclei on the surface of a substrate, particulate glass must be prepared by melting $CaO—SiO_2$ glass, crushing, and classifying. A method in which a substrate is phosphorylated requires intricate operations, i.e., phosphorylation of a substrate and partial post-hydrolysis.

In this connection, the present inventors have previously proposed a method for forming a hydroxyapatite coating film without requiring these intricate operations. Briefly, the method comprises the following steps: soaking a substrate in an aqueous solution containing at least calcium and phosphorus; removing the substrate from the aqueous solution and drying the substrate; soaking the dried substrate in an aqueous solution in which a hydroxyapatite component is dissolved at a substantially saturated or supersaturated concentration, to thereby form a hydroxyapatite coating film on the surface of a substrate. The method enables deposition of hydroxyapatite through simple operations. However, depending on the type of a substrate or in the case of a substrate having a large size, hydroxyapatite might be deposited on the surface to an insufficient concentration or a heterogeneous thickness. This is considered to be attributable to failure to attain homogeneous deposition of a calcium phosphate compound serving as a precursor of hydroxyapatite on the surface of the substrate.

SUMMARY OF THE INVENTION

In the present invention, the expression "calcium phosphate" should not be interpreted narrowly, but should rather be interpreted broadly encompassing any calcium phosphate species in addition to calcium ortho phosphate. Also, the terms "calcium" and "phosphorus" used in the specification should be interpreted as calcium ion(s) or phosphate ion(s) where appropriate.

In order to solve the above-described problems involved in the prior art, an object of the present invention is to provide a method of forming a coating film comprising hydroxyapatite or a mixture containing hydroxyapatite and a hydroxyapatite precursor on the surface of a substrate by use of two or three specific kinds of aqueous solutions, such as a solution containing at least phosphorus or calcium, without particular high-temperature treatment. Therefore, the present invention, which enables application of a coating film to a substrate having poor heat resistance, is contemplated to provide a method for producing a calcium phosphate coating film that enables formation of a homogeneous coating film containing hydroxyapatite on a surface regardless of the kind and size of the substrate.

According to a first aspect of the present invention, there is provided a method for producing a calcium phosphate coating film, which method comprises the following two steps:

Step 1: soaking a substrate in a first solution containing at least phosphorus and substantially no dissolved calcium, removing the substrate from the first solution, and drying the substrate; and Step 2: soaking the dried substrate in a second solution having pH of at least 8 and containing at least calcium, to thereby form on the surface of the above-described substrate a coating film containing hydroxyapatite and, optionally, a hydroxyapatite precursor.

According to a second aspect of the present invention, there is provided a method for producing a calcium phosphate coating film, which method comprises the following three steps:

Step 1: soaking a substrate in a first solution containing at least phosphorus and substantially no dissolved calcium, removing the substrate from the first solution, and drying the substrate;

Step 2: soaking the dried substrate in a second solution having a pH of at least 8 and containing at least calcium, to thereby form a coating film containing hydroxyapatite and, optionally, a hydroxyapatite precursor; and Step 3: soaking the substrate removed from the second solution in a third solution in which an apatite component is dissolved at a substantially saturated or supersaturated concentration, to thereby form on the surface of the above-described substrate a coating film containing hydroxyapatite and, optionally, a hydroxyapatite precursor.

According to a third aspect of the present invention, there is provided a method for producing a calcium phosphate coating film, which method comprises the following two steps:

Step 1: soaking a substrate in a fourth solution containing at least calcium and substantially no dissolved phosphorus, removing the substrate from the fourth solution, and drying the substrate; and Step 2: soaking the dried substrate in a fifth solution having a pH of at least 8 containing at least phosphorus, to thereby form a coating film as in the case of the first aspect of the present invention.

According to a fourth aspect of the present invention, there is provided a method for producing a calcium phosphate coating film, which method comprises Step 1 and Step 2 of the third aspect of the present invention, followed by Step 3: soaking the substrate a third solution in which an apatite component is dissolved at a substantially saturated or supersaturated concentration, to thereby form a coating film as in the case of the second aspect of the present invention.

DETAILED DESCRIPTION OF PREFERRED EMBODIMENTS

Figure 1:
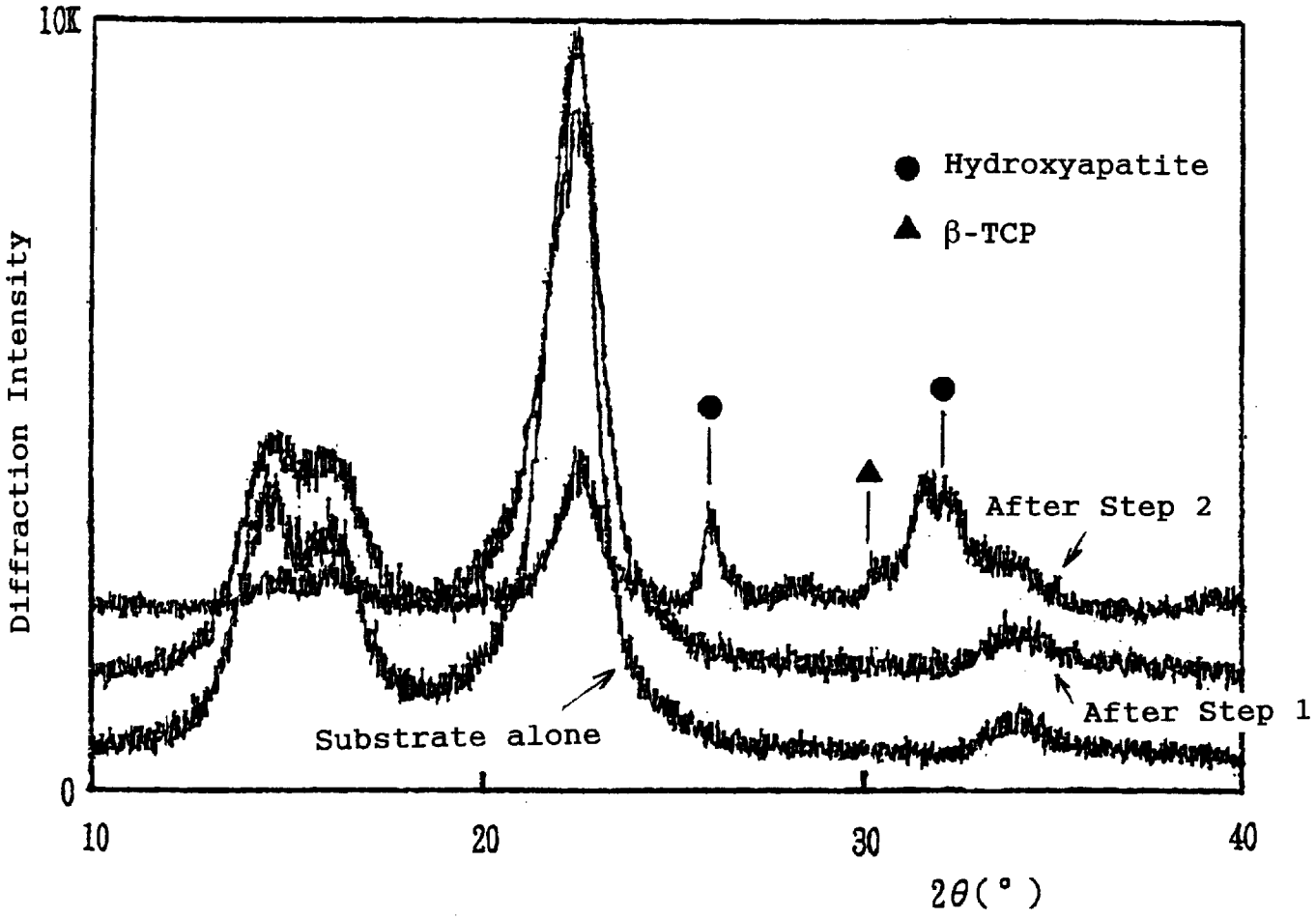
FIG. 1 is an X-ray diffraction chart showing in the first and second aspects of the present invention, diffraction of the surface of the substrate before formation of a coating film, diffraction of the same after performance of Step 1, and diffraction of the top surface of the multi-coated substrate after formation of a coating film containing hydroxyapatite.

In the first aspect of the present invention and the second aspect of the present invention, the above-described "first solution" contains substantially no dissolved calcium. The above-described "second solution" preferably contains substantially no dissolved phosphorus. When the first solution or the second solution contains both phosphorus and calcium, a calcium phosphate compound is formed and precipitated to remarkably decrease the amount of calcium phosphate deposited on the surface of a substrate. Furthermore, in the third aspect of the present invention and the fourth aspect of the present invention, the above-described "fourth" solution contains substantially no dissolved phosphorus, and the above-described "fifth solution" preferably contains substantially no dissolved calcium. In the above-described invention, the expression "containing substantially no dissolved phosphorus or calcium" broadly refers, in addition to a state in which a solution contains neither calcium ions nor phosphate ions at all, to the case in which the solution contain calcium ions or phosphate ions in very small amounts such that the amount of a calcium phosphate compound deposited on the surface of a substrate is not significantly reduced. Specifically, calcium and phosphorus may coexist in amounts satisfying the following relationship regarding solubility range at a solution temperature of 25° C.:

$$[Ca^{2+}]^5\times[PO_4^{3-}]^3\times[OH^-]<2.35\times10^{-59}.$$

In the first aspect of the present invention, the third aspect of the present invention, etc., the term "hydroxyapatite precursor" refers to calcium phosphate compounds which are deposited under almost neutral conditions, such as amorphous calcium phosphate (ACP), tricalcium phosphate (TCP), octacalcium phosphate (OCP; $Ca_8H_2(PO_4)_6.5H_2O$), or dicalcium phosphate dihydrate (DCPD).

In the first and second aspects of the present invention, the first solution is preferably a solution of "a basic phosphate salt." Furthermore, the pH of the second solution is regulated to an alkaline region, i.e. to "at least 8," particularly at least 8.5, more particularly at least 9. By regulating the first solution and the second solution as described above, the vicinity of a substrate becomes basic so as to advantageously facilitate deposition of a calcium phosphate compound during Step 2. Therefore, a calcium phosphate compound which is deposited under almost neutral conditions can be deposited to a greater amount on the surface of a substrate, and a coating film comprising hydroxyapatite or a mixture containing hydroxyapatite and a hydroxyapatite precursor can be formed with greater efficacy. From on the same reason, the pH of the fifth solution is "at least 8" in the third and the fourth aspects of the present invention, and the pH is preferably regulated to an alkaline region of a higher pH. Examples of the basic phosphate salts include $Na_3PO_4$, $Na_2HPO_4$, $K_3PO_4$, and $K_2HPO_4$.

Furthermore, in the first, second, third, and fourth aspects of the present invention, the substrate which is being soaked in the first or the fourth solution is preferably "subjected to sonication" during Step 1, in order to deposit a calcium phosphate compound more homogeneously in Step 2. In particular, when the substrate is fabric, a solution penetrates into interfiber space and over the entirety of the substrate during sonication, to thereby yield a substrate in which a calcium phosphate compound adheres over the entirety of the substrate. The resultant substrate is soaked in the second or the fifth solution, to thereby form a coating film containing more homogeneous hydroxyapatite. Typically, an aqueous solution is used as the first and the fourth solutions in Step 1, and there may also be used a solution which contains an organic solvent or a mixture of an organic solvent and water. The second and the fifth solutions used in Step 2 are preferably a solution containing water as a solvent, i.e. an aqueous solution.

The above-described Step 1 and Step 2 may be performed at about 10–50° C., i.e., ambient temperature of 20–35° C. Thus, Step 1 and Step 2 may be easily performed by use of a simple apparatus without particular heating or cooling. The soaking time, which depends on soaking temperature, is not particularly limited, and is several minutes to several hours for Step 1 and several hours to several tens of hours for Step 2.

In the first, second, third, and fourth aspects of the present invention, the above-described "substrate" is preferably hydrophilic. When the substrate is hydrophobic, the substrate is insufficiently wetted with an aqueous solution, to thereby disturb homogeneous deposition of a calcium phosphate compound. In order to increase surface wettability of the substrate to an aqueous solution, there is preferably used a substrate having a "hydrophilic group," or preferably introducing a "hydrophilic group" in the surface of the substrate in advance. The surface contact property of the substrate and solution may also be increased by "roughening" the surface of the substrate in advance. Thus, a coating film containing more homogeneous hydroxyapatite can be formed by enhancing the hydrophilicity of the surface of the substrate.

No particular limitation is imposed on the kind of the substrate, and there may be used substrates formed of metal, ceramics, or organic polymer materials. Since the present invention requires no high-temperature treatment, it can be applied to a substrate formed of a material which has poor heat resistance and is denatured through high-temperature treatment, particularly such as the above-described "organic polymer material." Examples of the substrate having poor heat resistance include natural fibers, fabric formed of synthetic fibers, non-woven fabric, knit, and cloth such as felt. There may also be used a variety of foamed resins containing cells in communication with each other, formed of, e.g., polyurethane, polystyrene, or polyolefins such as polyethylene or polypropylene. Moreover, porous film and porous, hollow-yarn-made membrane formed of polyethylene, polypropylene, etc. may also be used. By use of these substrates, a variety of filter materials may be obtained.

In the present invention, a coating film comprising hydroxyapatite or a mixture containing hydroxyapatite and a hydroxyapatite precursor can be formed on the surface of a substrate through Step 1 and Step 2 of the first and third aspects of the present invention. When only Step 1 and Step 2 are performed, a coating film consisting solely of hydroxyapatite may not be obtained. Therefore, in order to induce substantially exclusive deposition of hydroxyapatite on the surface of a substrate more surely in a larger amount, Step 2 of the first and the third aspects of the present invention is followed by the above-described "Step 3," as in the case of the second and the fourth aspects of the present invention.

The above-described "third solution" used in Step 3 preferably has a pH of 5–9. When the pH is less than 5, formed hydroxyapatite is dissolved in water, to thereby cause thinning of the coating film, whereas when it is in excess of 9, hydroxyapatite precipitates in the solution, to thereby cause possible failure of selective deposition onto the surface of a substrate. Moreover, as the third solution, there is preferably used a simulated body fluid in which the concentrations of respective ion species shown in Table 1 are 1–1.5 times those of a standard body fluid (in the case of 1.5 times, the expression 1.5×SBF will be used hereafter). A simulated body fluid having such concentration is preferred in that the ionic balance is maintained with stability for a long period.

The temperature of the third solution is preferably 10–70° C. When the temperature is less than 10° C., the amount of deposition of hydroxyapatite decreases, whereas when it is in excess of 70° C., a phosphorus compound such as TCP is formed instead of hydroxyapatite. The temperature of the third solution is preferably 20–60° C., particularly preferably 25–45° C., which temperature allows deposition of hydroxyapatite in a desirable amount. No particular limitation is imposed on the soaking time in the third solution, and a soaking time of several days is possible. The third solution is preferably a solution containing water as a solvent, i.e. an aqueous solution.

The mechanism for formation of coating film containing hydroxyapatite on the surface of a substrate is not clearly elucidated; however, it is assumed to be as follows.

In the first aspect of the invention, a substrate is soaked in the first solution containing phosphate ions and dried, to thereby deposit a phosphate salt on the surface during Step 1. Subsequently, when the dried substrate is soaked in the second solution containing calcium ions, the phosphate salt deposited during Step 1 is once dissolved into the solution. However, the concentration of phosphate ions or calcium ions increases in the vicinity of the substrate to induce supersaturation, to thereby deposit hydroxyapatite or its precursor calcium phosphate compound on the surface of the substrate prior to diffusion of phosphate ions into the solution. Then, according to the second aspect of the present invention, the substrate is soaked in the third solution, to thereby incorporate $Ca^{2+}$ and $HPO_4^{2-}$ present in the solution into a coating film containing hydroxyapatite formed in Step 2 and to grow a hydroxyapatite coating film.

In the third aspect of the present invention, during Step 1 and Step 2 there are used the fourth solution containing calcium ions and the fifth solution containing phosphate ions, respectively. As in the case of the first aspect of the present invention, hydroxyapatite or a calcium phosphate compound serving as a precursor thereof can be deposited on the surface of a substrate. Furthermore, in the fourth aspect of the present invention, the substrate is soaked in the third solution, to thereby incorporate $Ca^{2+}$ and $HPO_4^{2-}$ present in the solution into a coating film containing hydroxyapatite formed in Step 2 and to grow a hydroxyapatite coating film having a greater thickness.

EXAMPLES

The present invention will next be described by way of examples, which should not construed as limiting the invention.

Example 1

Step 1: $K_2HPO_4$ was dissolved in water, to thereby prepare a first solution (aqueous solution) having a concentration of 1 mol/l. The pH of the first solution was 9. The first solution (20 ml) was placed into a bath of an ultrasonic washer, in which a substrate formed of 100% cellulose fabric (approximately 0.03 g) was soaked. The temperature of the first solution was 25° C. and the soaking time was 10 minutes. During soaking, the substrate was subjected to sonication. Then, the substrate was removed from the washer and dried at 60° C. in a thermostatic chamber while the solution adhered on the surface of the substrate.

Step: 2 The dried substrate was soaked in a 1 mol/l aqueous solution of $CaCl_2$ (second solution) at 25° C. for 24 hours. The pH of the second solution was 7.3. The substrate was removed, washed, and dried at 60° C. X-ray diffraction analysis after performance of Step 2 confirmed that a coating film comprising hydroxyapatite and TCP was formed on almost the entire surface of the substrate. The weight of the substrate increased in an amount of approximately 0.046 g, which corresponds to the weight of the formed coating film.

FIG. 1 is an X-ray diffraction chart showing diffraction of the surface of the substrate before formation of a hydroxyapatite coating film (indicated as "Substrate alone"), diffraction of the same after performance of Step 1 in Example 1 (indicated as "After Step 1"), and diffraction of the top surface of the multi-coated substrate after formation of a hydroxyapatite coating film containing TCP (indicated as "After Step 2"). As is clear from FIG. 1, no diffraction peak attributed to hydroxyapatite is observed for "Substrate alone" or for "After Step 1," and two diffraction peaks attributed to hydroxyapatite ($2\theta$=26° and 32°) and one diffraction peak attributed to TCP ($2\theta$=30°) are observed for "After Step 2."

Example 2

The procedure of Example 1 was performed, except that $K_2HPO_4$ was dissolved in water, to thereby prepare an aqueous solution having a pH of 9 and a concentration of 10 mmol/l to serve as a first solution. After completion of washing of Step 2 in Example 1, the substrate was soaked in a third solution (250 ml) having a composition and concenthration of ions shown in Table 1 (which corresponds to 1.5×SBF). The pH of the third solution was regulated to approximately 7.2 by use of trishydroxymethylaminomethane and hydrochloric acid. The temperature of the third solution was 36.5° C. and the soaking time was 48 hours. The substrate was removed, washed, and dried at 60° C. A hydroxyapatite coating film was formed on almost the entire surface of the substrate through performance of Step 3. The weight of the substrate increased in an amount of approximately 0.014 g, which corresponds to the weight of the formed coating film.

TABLE 1

Composition of 1.5 × SBF (Simulated Body Fluid)

(unit: mmol/l)

| Ion species | $Na^+$ | $K^+$ | $Ca^{2+}$ | $Mg^{2+}$ | $Cl^-$ | $HCO_3^-$ | $HPO_4^{2-}$ | $SO_4^{2}$ |
|---|---|---|---|---|---|---|---|---|
| Composition | 213 | 7.5 | 3.8 | 2.3 | 223 | 6.3 | 1.5 | 0.75 |

Example 3

The procedure of Example 2 was performed, except that $Na_2HPO_4$ was dissolved in water, to thereby prepare an aqueous solution having a pH of 9 and a concentration of 10 mmol/l to serve as a first solution in Step 1. A hydroxyapatite coating film was formed on almost the entire surface of the substrate. The weight of the substrate increased in an amount of approximately 0.019 g.

Example 4

The procedure of Example 2 was performed, except that $Na_3PO_4$ was dissolved in water, to thereby prepare an aqueous solution having a pH of 11.5 and a concentration of 10 mmol/l to serve as a first solution in Step 1. A hydroxyapatite coating film was formed on almost the entire surface of the substrate. The weight of the substrate increased in an amount of approximately 0.018 g.

Example 5

The procedure of Example 2 was performed, except that $(NH_4)_2HPO_4$ was dissolved in water, to thereby prepare an aqueous solution having a pH of 8 and a concentration of 10 mmol/l to serve as a first solution in Step 1 and that a saturated aqueous solution of $Ca(OH)_2$ having a pH of 12 or more was used as a second solution in Step 2. A hydroxyapatite coating film was formed on almost the entire surface of the substrate. The weight of the substrate increased in an amount of approximately 0.016 g.

Examples 6 to 8

The procedure of Example 5 was performed, except that solutions having a pH 8, 9, and 10 were prepared by adding ammonia to a 1 mol/l aqueous solution of $CaCl_2$ to serve as second solutions in Step 2. In each Example, a hydroxyapatite coating film was formed on almost the entire surface of the substrate. The weight increases of the substrates were approximately 0.001 g, 0.011 g, and 0.014 g, respectively. Thus, when the pH is 9 and 10, hydroxyapatite is deposited in an amount greater than in the case in which the pH is 8.

Comparative Examples 1 and 2

The procedure of Example 5 was performed, except that solutions having a pH 6 and 7 were prepared by adding hydrochloric acid to a 1 mol/l aqueous solution of $CaCl_2$ to be used as second solutions in Step 2. However, no hydroxyapatite coating film was formed and no weight change of the substrates was observed.

Comparative Example 3

The procedure of Step 1 in Example 1 was performed, except that a simulated body fluid used as the third solution in Example 2 was used and 100% cellulose non-woven fabric (approximately 0.14 g) was used as a substrate. Step 2 was omitted, and the procedure of Step 3 in Example 2 was performed, except that the above-described simulated body fluid was used as a third solution and the soaking time was six days. However, hydroxyapatite coating film was formed in a tiny amount and the weight change of the substrate was less than 0.001 g.

Example 9

Step 1: $CaCl_2$ was dissolved in water, to thereby prepare a fourth solution (aqueous solution) having a concentration of 1 mol/l. The pH of the fourth solution was 7.3. The fourth solution (20 ml) was placed in a bath of an ultrasonic washer, in which a substrate formed of 100% cellulose fabric (approximately 0.03 g) was soaked. The temperature of the fourth solution was 25° C. and the soaking time was 10 minutes. During soaking, the substrate was subjected to sonication. Then, the substrate was removed from the washer and dried at 60° C. in a thermostatic chamber while the solution adhered on the surface of the substrate.

Step: 2 The dried substrate was soaked in a 1 mol/l aqueous solution of $K_2HPO_4$ (fifth solution) at 25° C. for 24 hours. The pH of the fifth solution was 9. The substrate was removed, washed, and dried at 60° C. X-ray diffraction analysis after performance of Step 2 confirmed that a coating film comprising hydroxyapatite and TCP was formed on almost the entire surface of the substrate. The weight of the substrate increased in an amount of approximately 0.017 g, which corresponds to the weight of the formed coating film.

Example 10

The procedure of Example 9 was performed, except that $CaCl_2$ was dissolved in water, to thereby prepare a fourth solution having a pH of 7.3 and a concentration of 10 mmol/l. After completion of washing of Step 2 in Example 9, the substrate was soaked in the same third solution (250 ml) as used in Example 2. The pH of the third solution was regulated to approximately 7.2 as in the case of Example 2. Thus, Step 3 was performed in a manner similar to that in the case of Example 2. X-ray diffraction analysis after performance of Step 3 confirms that a hydroxyapatite coating film is formed on almost the entire surface of the substrate. The weight of the substrate increased in an amount of approximately 0.014 g, which corresponds to the weight of the formed coating film.

Figure 2:
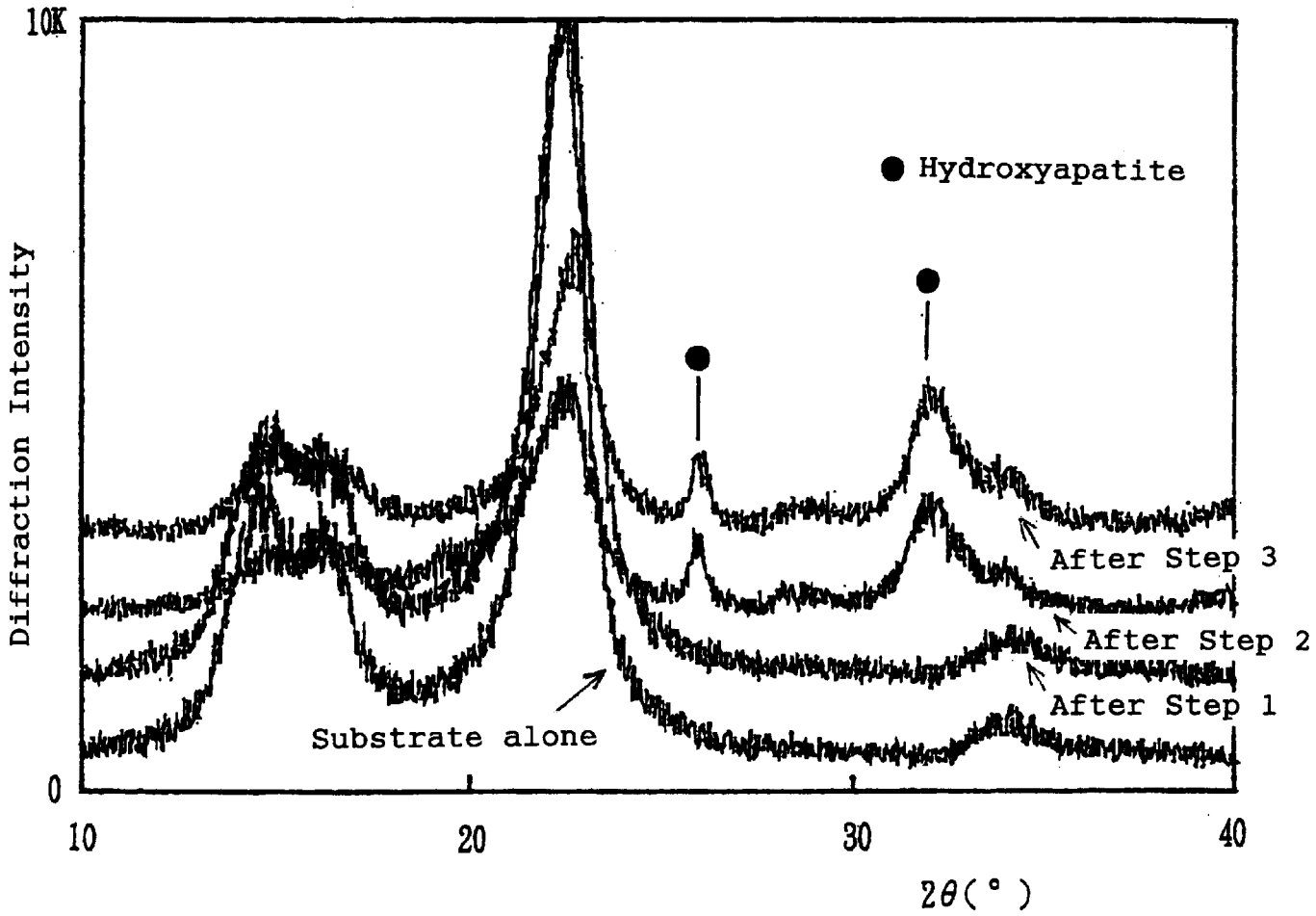
FIG. 2 is an X-ray diffraction chart showing, in the third and fourth aspects of the present invention, diffraction of the surface of the substrate before formation of a coating film, diffraction of the same after performance of Step 1, and diffraction of the top surface of the multi-coated substrate after performance of Step 2 and Step 3 to form a hydroxyapatite coating film.

FIG. 2 is an X-ray diffraction chart showing diffraction of the surface of the substrate before formation of a hydroxyapatite coating film (described as "Substrate"), diffraction of the same after performance of Step 1 in Example 10 (described as "After Step 1"), and diffraction of the top surface of the multi-coated substrate after performance of Step 2 and Step 3 to form a hydroxyapatite coating film (described as "After Step 2" and "After Step 3," respectively). As is clear from FIG. 2, no diffraction peak attributed to hydroxyapatite is observed for "Substrate" and "After Step 1," and two diffraction peaks attributed to hydroxyapatite are observed for "After Step 2" as in the case of Example 1. Greater diffraction intensity is observed for these two peaks for "After Step 3," proving that Step 3 increases the amount of deposition of hydroxyapatite.

Examples 11 to 13

The procedure of Example 10 was performed, except that solutions having a pH 8, 9, and 9.6 were prepared by adding ammonia to a 1 mol/l aqueous solution of $(NH_4)_2HPO_4$ and were used as fifth solutions in Step 2. In each Example, a hydroxyapatite coating film was formed on almost the entire surface of the substrate. The weight increases of the substrates were approximately 0.008 g, 0.015 g, and 0.013 g, respectively. Thus, when the pH is 9 and 9.6, hydroxyapatite is deposited in an amount greater than in the case in which the pH is 8.

Comparative Examples 4 and 5

The procedure of Example 10 was performed, except that solutions having a pH 6 and 7 were prepared by adding hydrochloric acid to a 1 mol/l aqueous solution of $(NH_4)_2HPO_4$ and were used as fifth solutions of Step 2. However, no hydroxyapatite coating film was formed and no weight change of the substrates was observed.

Example 14

The procedure of Example 10 was performed, except that 100% cellulose non-woven fabric (approximately 0.14 g) was used as a substrate and the soaking time was five days. A hydroxyapatite coating film was formed on almost the entire surface of the substrate. The weight of the substrate increased in an amount of approximately 0.036 g. Thus, it has been proven that as a result of the method of the present invention, hydroxyapatite was sufficiently and homogeneously deposited regardless of the kind and size of the substrate.

As described hereinabove, in accordance with the first and third aspects of the present invention, there can be formed a coating film comprising hydroxyapatite or a mixture containing hydroxyapatite and a hydroxyapatite precursor on the surface of a substrate, particularly on the surface of a substrate having poor heat resistance such as woven fabric or non-woven fabric formed of synthetic fibers. In accordance with the second and fourth aspects of the present invention, addition of Step 3 allows ensured deposition of hydroxyapatite and increase of the amount of deposition thereof.

What is claimed is:

1. A method for producing a calcium phosphate coating film, which method comprises the following two steps:

Step 1: soaking a substrate in a first solution composed of an inorganic phosphate containing at least phosphorus and substantially no dissolved calcium, removing the substrate from the first solution, and drying and substrate; and Step 2: soaking the dried substrate in a second solution having pH of at least 8 and composed of an inorganic calcium compound containing at least calcium; to thereby form on the surface of the above-described substrate a coating film containing hydroxyapatite and, optionally, a hydroxyapatite precursor.

2. A method for producing a calcium phosphate coating film, which method comprises the following three steps:

Step 1: soaking a substrate in a first solution composed of an inorganic phosphate containing at least phosphorus and substantially no dissolved calcium, removing the substrate from the first solution, and drying the substrate;

Step 2: soaking the dried substrate in a second solution having a pH of at least 8 and composed of an inorganic calcium compound containing at least calcium, to thereby form a coating film containing hydroxyapatite and, optionally, a hydroxyapatite precursor; and Step 3: soaking the substrate removed from the second solution in a third solution in which an apatite component is dissolved at a substantially saturated or supersaturated concentration; to thereby form on the surface of the above-described substrate a coating film containing hydroxyapatite, and optionally, a hydroxyapatite precursor.

3. A method for producing a calcium phosphate coating film according to claim 1, wherein the second solution contains substantially no dissolved phosphorus.

4. A method for producing a calcium phosphate coating film according to claim 2, wherein the second solution contains substantially no dissolved phosphorus.

5. A method for producing a calcium phosphate coating film according to claim 1, wherein the first solution is a solution of a basic phosphate salt.

6. A method for producing a calcium phosphate coating film according to claim 2, wherein the first solution is a solution of a basic phosphate salt.

7. A method for producing a calcium phosphate coating film according to claim 1, wherein the substrate which is being soaked in the first solution is subjected to a sonication treatment.

8. A method for producing a calcium phosphate coating film according to claim 2, wherein the substrate which is being soaked in the first solution is subjected to a sonication treatment.

9. A method for producing a calcium phosphate coating film, which method comprises the following two steps:

Step 1: soaking a substrate in a first solution composed of an inorganic calcium compound containing at least calcium and substantially no dissolved phosphorus, removing the substrate from the first solution, and drying the substrate; and Step 2: soaking the dried substrate in a second solution having a pH of at least 8 and composed of an inorganic phosphate containing at least phosphorus; to thereby form on the surface of the above-described substrate a coating film containing hydroxyapatite and, optionally, a hydroxyapatite precursor.

10. A method for producing a calcium phosphate coating film, which method comprises the following three steps:

Step 1: soaking a substrate in a first solution composed of an inorganic calcium compound containing at least calcium and substantially no dissolved phosphorus, removing the substrate from the first solution, and drying the substrate;

Step 2: soaking the dried substrate in a second solution having a pH of at least 8 and composed of an inorganic phosphate containing at least phosphorus: and Step 3: soaking the substrate in a third solution in which an apatite component is dissolved at a substantially saturated or supersaturated concentration; to thereby form on the surface of the above-described substrate a coating film containing hydroxyapatite and, optionally, a hydroxyapatite precursor.

11. A method for producing a calcium phosphate coating film according to claim 9, wherein the second solution contains substantially no dissolved calcium.

12. A method for producing a calcium phosphate coating film according to claim 10, wherein the second solution contains substantially no dissolved calcium.

13. A method for producing a calcium phosphate coating film according to claim 9, wherein the substrate which is being soaked in the first solution is subjected to a sonication treatment.

14. A method for producing a calcium phosphate coating film according to claim 10, wherein the substrate which is being soaked in the first solution is subjected to a sonication treatment.

15. A method for producing a calcium phosphate coating film according to claim 1, wherein the substrate contains a hydrophilic group.

16. A method for producing a calcium phosphate coating film according to claim 2, wherein the substrate contains a hydrophilic group.

17. A method for producing a calcium phosphate coating film according to claim 9, wherein the substrate contains a hydrophilic group.

18. A method for producing a calcium phosphate coating film according to claim 10, wherein the substrate contains a hydrophilic group.

19. A method for producing a calcium phosphate coating film according to claim 15, wherein the hydrophilic group is contained in the surface portion of the substrate.

20. A method for producing a calcium phosphate coating film according to claim 1, wherein the substrate has a rough surface.

21. A method for producing a calcium phosphate coating film according to claim 1, wherein the substrate is made of an organic polymer material.

22. The method for producing a calcium phosphate coating film according to claim 21, wherein the organic polymer material is a type of woven fabric formed of natural fibers.

23. The method for producing a calcium phosphate coating film according to claim 2, wherein the substrate is comprised of a type of woven fabric formed of natural fibers.

24. The method for producing a calcium phosphate coating film according to claim 9, wherein the substrate is comprised of a type of woven fabric formed of natural fibers.

25. The method for producing a calcium phosphate coating film according to claim 10, wherein the substrate is comprised of a type of woven fabric formed of natural fibers.

26. The method for producing a calcium phosphate coating film according to claim 1, wherein the substrate is comprised of one of the group consisting of synthetic fibers, non-woven fabric, knit, and felt.

27. The method for producing a calcium phosphate coating film according to claim 2, wherein the substrate is comprised of one of the group consisting of synthetic fibers, non-woven fabric, knit, and felt.

28. The method for producing a calcium phosphate coating film according to claim 9, wherein the substrate is comprised of one of the group consisting of synthetic fibers, non-woven fabric, knit, and felt.

29. The method for producing a calcium phosphate coating film according to claim 10, wherein the substrate is comprised of one of the group consisting of synthetic fibers, non-woven fabric, knit, and felt.

* * * * *